US006746336B1

(12) United States Patent
Brant et al.

(10) Patent No.: US 6,746,336 B1
(45) Date of Patent: Jun. 8, 2004

(54) POOL CUE ALIGNMENT AND TRAINING APPARATUS

(75) Inventors: Kevin J. Brant, Akron, OH (US); Cameron L. Croxton, Akron, OH (US)

(73) Assignees: James R. Brant, Lewisburg, WV (US); Linda L. Brant, Lewisburg, WV (US); Kyle R. Brant, Mulberry, FL (US); Richard K. Brown, Sr., Akron, OH (US); Dona K. Burgess, Akron, OH (US); Wade Deyoung, Ravenna, OH (US); Philip E. German, Sr., Canal Fulton, OH (US); Albert O. Klaben, Sr., Jupiter, FL (US); James Midock, Cuyahoga Falls, OH (US); Andria Allgood, Cuyahoga Falls, OH (US); Mandy S. Morris, Reader, WV (US); Joseph C. Pomponio, Jr., Lewisburg, WV (US); Betty F. Pomponio, Lewisburg, WV (US); Richard W. Varner, Ravenna, OH (US)

( * ) Notice: Subject to any disclaimer, the term of this patent is extended or adjusted under 35 U.S.C. 154(b) by 0 days.

(21) Appl. No.: 10/274,329

(22) Filed: Oct. 18, 2002

Related U.S. Application Data

(63) Continuation-in-part of application No. 09/648,881, filed on Aug. 25, 2000, now abandoned.

(51) Int. Cl.[7] ..... A63D 15/08

(52) U.S. Cl. ..... 473/44

(58) Field of Search ..... 473/2, 44–46, 473/42

(56) References Cited

U.S. PATENT DOCUMENTS

| | | | | | |
|---|---|---|---|---|---|
| 4,688,796 | A | * | 8/1987 | Wright | 473/46 |
| 5,181,718 | A | * | 1/1993 | Valentine | 473/45 |
| 5,738,595 | A | * | 4/1998 | Carney | 473/2 |
| 6,017,277 | A | * | 1/2000 | Chuang | 473/44 |
| 6,117,019 | A | * | 9/2000 | Taylor | 473/46 |
| 6,155,929 | A | * | 12/2000 | Chipman | 473/2 |

* cited by examiner

*Primary Examiner*—Mark S. Graham
(74) *Attorney, Agent, or Firm*—John D. Gugliotta; Olen L. York, III

(57) ABSTRACT

An pool cue aiming apparatus for billiards games includes a cue provided with a source for a narrow collimated beam of light emerging from the playing tip along the longitudinal axis of the cue. An electrical communication system is located within the cue, having a pressure sensitive handle housing batteries, thereby transmitting electricity when the handle is depressed and closes an electrical circuit. Electricity generated from the batteries is transmitted to a light source in the tip portion of the cue and the light therefrom moves through a longitudinal bore along the length of the cue to emerge from an orifice located at the striking tip. The collimated light allows a user to learn proper striking technique in the game of billiards.

19 Claims, 5 Drawing Sheets

POOL CUE ALIGNMENT AND TRAINING APPARATUS

RELATED APPLICATIONS

The present invention is a continuation-in-part of U.S. patent application Ser. No. 09/648,881, filed Aug. 25, 2000, abandoned.

BACKGROUND OF THE INVENTION

1. Field of the Invention

The present invention relates to pool cues for use in playing the game of billiards and, more particularly, to a pool cue having two removable, interchangeable striking tips, one tip modified to contain beam generation means to aid in targeting the pool cue to a proper position and angle, wherein the beam generation means is activated by the touch of a user.

2. Description of the Related Art

Billiards continually ranks among the most popular of the recreational or sporting activities that many people enjoy. Ranging in intensity from the casual types that shoot pool periodically to the serious shooters that play several times a week, thousands of people play pool on a daily basis. As is common with all sports and hobbies, the participant strives for continual improvement and refinement. While practice and coaching from more advanced players will certainly help in this regard, there is a lack of products on the market to help the novice to average pool player. This is in stark contrast to other sports, such as golf, baseball, soccer or football, in which products and training aids flood the market and fill virtually all sporting goods stores.

Specifically, aiming is required in every shot in billiards or pocket billiards. In pocket billiards, the cue propels the cue ball at a first target ball in order to direct the target ball in a certain path either directly or indirectly toward a pocket while trying to avoid scratching, i.e. entry of the cue ball into a pocket. The trajectory of the target ball and the cue ball are both controlled by the manner in which the cue stick contacts the cue ball. The spot at which the cue stick hits the cue ball determines its spin during and after contact with the target ball. For example, if the point of the cue stick contacts the cue ball below its mid point, reverse spin is applied to the cue ball and it will tend to return toward the cue stick after contacting the target ball.

Conversely, if the spot at which the cue stick makes contacts is above and mid point of the cue ball, forward spin is applied to the ball and it will tend to follow the target ball after contact therewith. Similarly, right-hand and left-hand spin can then be applied to the cue ball by choosing a contact spot to the left or the right of a vertical plane through the mid-point of the cue ball.

It is very rare to find any play situation in which the pocket, target ball and cue ball are all positioned in a straight line. This is the simplest aiming combination in which the player attempts to propel the cue ball in a straight line at the target ball which after impact rolls in a straight line into the pocket. In all other cases, the cue ball and target ball are out-of-line and the target ball must be contacted with the cue ball from a very acute angle on one edge of the target ball to a very acute angle on the other edge to propel the target ball over almost 180° of different lines of motion.

Another necessary skill that is common to both billiards and pocket billiards is the design and execution of banking shots. Banking requires traverse of the cue ball and/or target ball against at least one cushion before the ball comes to rest or enters a pocket. Many times the ball will contact three or four cushions and each time at a different angle. These shots are very hard to plan and to aim, especially if the table is crowded with many balls, as it is at the start of a rack.

Another way to estimate the pattern of travel of a ball during banking is to use diamond shaped marks spaced along the table rail behind the cushions and mentally project the point of contact of the ball between adjacent diamonds. Of course, a mechanical, mathematical device such as a protractor could be used to estimate or calculate the angle of travel.

A problem in aiming is that the player is positioned a substantial distance behind the cue ball and is sighting along a long cylindrical surface toward a spherical surface. It is difficult to align the cylindrical cue stick with the spherical cue ball, since there are no sharp points or edges for sighting. Secondly, the pointer spot of contact is usually hidden or obliterated by the cue stick itself.

A search of the prior art did not disclose any patents that read directly on the claims of the instant invention; however, the following references were considered related.

The following patents disclose a pool cue stick with a guiding rib:

U.S. Pat. No. 5,704,842 issued in the name of Petrusek; and

U.S. Pat. No. 3,389,911 issued in the name of Castiglione.

The following patents describe a pool cue alignment device with a laser mounted to the shaft:

U.S. Pat. No. 5,554,075 issued in the name of Glazer, and

U.S. Pat. No. 4,688,796 issued in the name of Wright.

The following patents describe a variety of pool cue alignment devices:

U.S. Pat. No. 5,558,584, issued in the name of Brown, discloses a pool cue with a sight or aiming aid;

U.S. Pat. No. 5,275,398, issued in the name of Compton, describes an apparatus for use with a billiard table including a stick assembly and arrays of light reflectors;

U.S. Pat. No. 5,181,718, issued in the name of Valentine, discloses a pool stick mounted in a biased relationship within a rifle stock;

U.S. Pat. No. 4,178,694, issued in the name of Bonney, describes a point-of-aim indicator for the game of billiards; and U.S. Pat. No. D 378,393, issued in the name of Marshall et al., discloses an ornamental design for a billiard table aiming system.

Of considerable relevance is U.S. Pat. No. 4,688,796, issued in the name of Wright. However, while the user of a collimated light source in combination with a pool cue stick is incorporated into this invention in combination, other elements are designed to overcome many problems that result from such a device as described in Wright. For example, such a device anticipates a central shaft, creating a hollow pool stick that would lack in weight, balance, and strength. Also, the battery power source being in the striking tip of the stick would also cause problems with weight, balance, and strength of the stick. Finally, such a device would be ineffective during the initial "break" of a billiards game, as well as potentially being subjected to damage due to the shock or jolt from such a strike.

Accordingly, and in keeping with advanced technology, there is a continual need for new and innovative features and improvements that will serve to enhance the game of billiards.

SUMMARY OF THE INVENTION

Therefore, it is an object of the invention to provide for pool cue having two removable, interchangeable striking tips.

It is a feature of the present invention that one such striking tip is modified to contain collimated light beam generation means to aid in targeting the alignment of the pool cue at a proper position and angle.

It is a further feature of the present invention to provide a pair of inductive wires embedded on the surface of the pool cue handle, wherein a user's hand completes a circuit between the wires and activates the projection of the beam.

Briefly described according to one embodiment of the present invention, a pool stick is provided with an integral laser aiming device for use in playing billiards. The invention resembles a conventional pool stick, having a linearly elongated shape with a taper at the striking end. A small hole can be viewed in the end of the pool stick away from the handle. A low power laser, similar to that used in a laser pointer for business presentations, is installed in the end of the pool cue and projects out from the small opening. The laser light axis is in perfect alignment with the centerline of the pool cue. A pair of small wires, running parallel along the top surface of the pool cue, act as capacitive touch switches and transmit power from a battery or batteries to effectuate transmittal of the laser.

To use the invention, the user lines up the stick behind the cue ball in the conventional manner, grasping the handle so as to close the circuit between the pair of wires and activating the capacitive touch switches. The tip of the stick is then raised slightly above the ball and aimed at the angle the user desires to strike the cue ball. The user then aligns the laser dot on the subject ball by moving the handle, while holding the tip in a relatively constant position. When the user is happy with the alignment, the handle is held in that position, the tip is lowered back down and the shot is completed in the normal manner. The invention is a three-piece design that allows the user to take it apart for transportation ease. The electrical connections would be made using internal electrical connectors that automatically make and break electrical current flow when the invention is assembled and disassembled. Additionally, the upper end of the cue stick having the laser is replaceable with a conventional cue stick end for break shots so the laser is not subjected to high forces and possible damage during such shots.

The use of the present invention allows billiard players the opportunity to improve their game in a manner which employs high technology in a fun, easy and efficient manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Referring now to FIGS. 1–7, a multi-component pool cue 10 is composed of a base handle portion 12, and a pair of removable tip portions 14 for interchangeably affixing to the distal end of the handle 12. The handle 12 is pressure sensitive so as to actuate the flow of electricity when a user grasps the handle 12 with a hand. The removable tips portions 14 include the combination of a threadable breaking tip 14*a* and a threadable aiming tip 14*b*.

Figure 1:
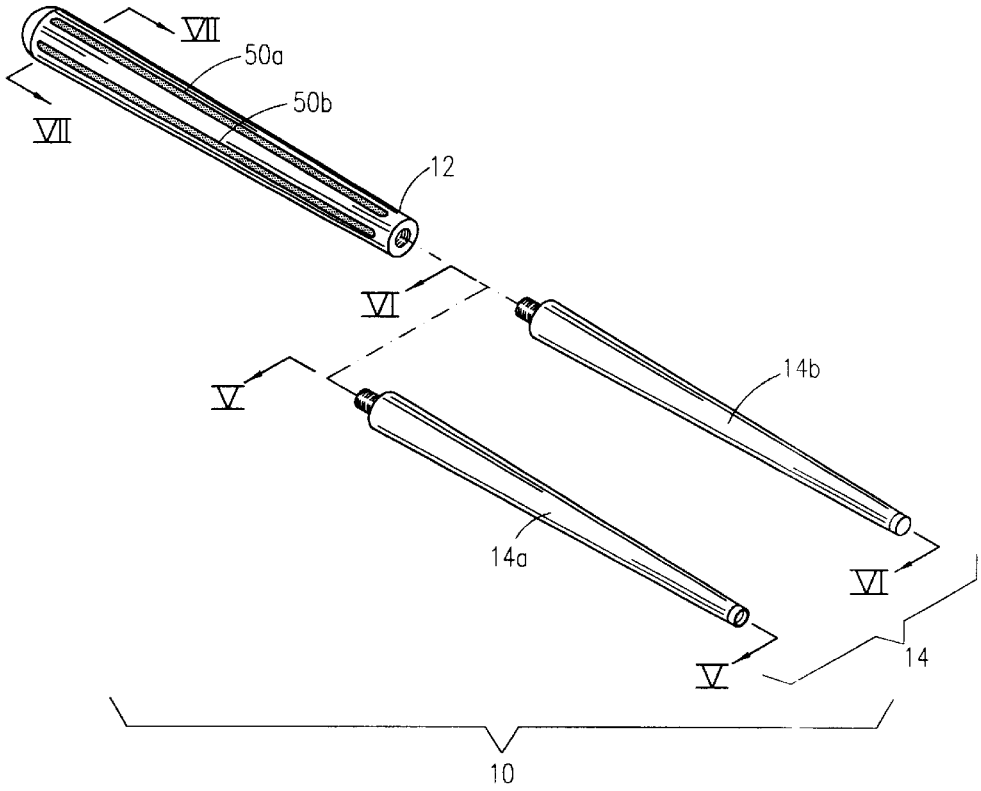
FIG. 1 is an exploded perspective view of a multi-component, pool cue alignment training aid in accordance with the preferred embodiment of the present invention.
Figure 2:
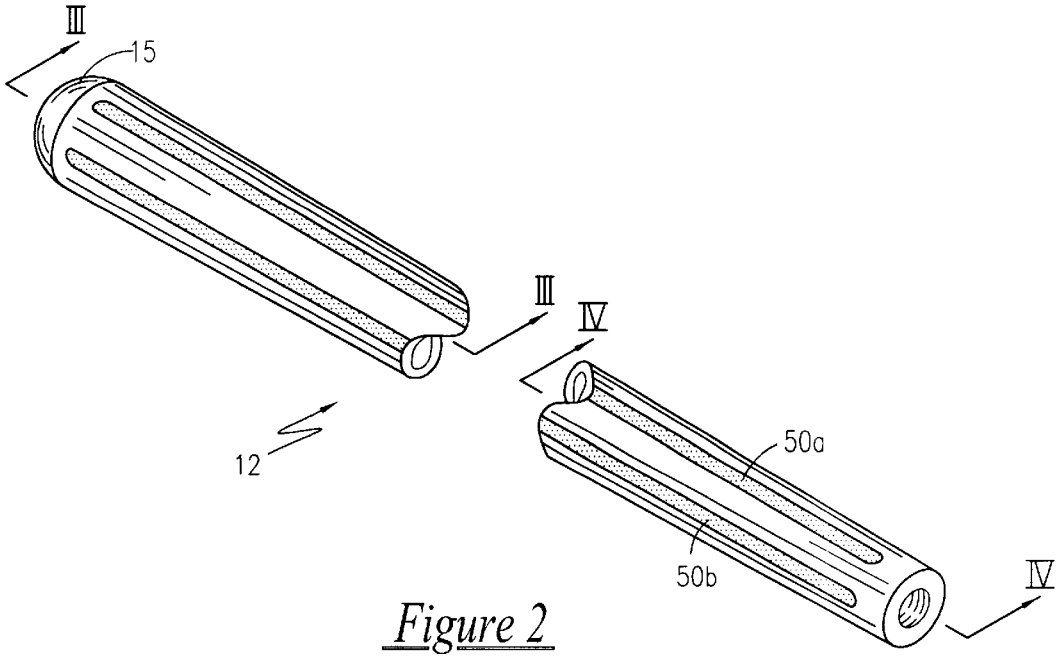
FIG. 2 is an enlarged detail in perspective of the handle of the pool cue of FIG. 1.
Figure 3:
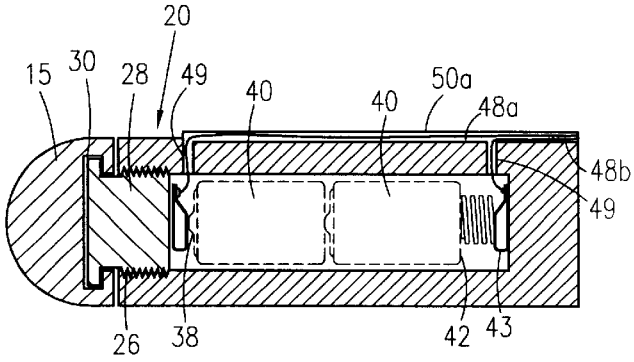
FIG. 3 is a view in section taken along the line III—III of FIG. 2.
Figure 4:
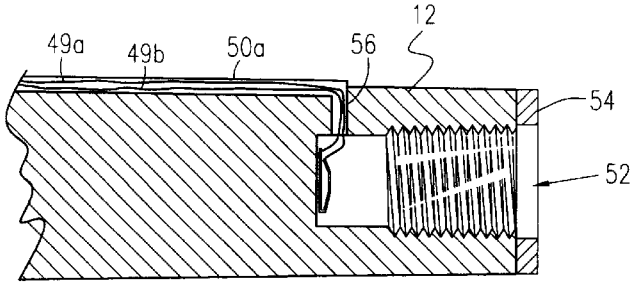
FIG. 4 is a view in section taken along the line IV—IV of FIG. 2.

In greater detail as shown in FIGS. 2–4, the handle 12 forms a shaft that has a cylindrical cross section which gently tapers from the handle 16 toward a tip portion 14. At the proximal end of the handle 12 (FIG. 3), a resilient bumper 15 can be removably attached to the handle end of the cue, and thereby providing access to a centrally bored chamber formed in the shaft 12 and forming a battery compartment 20. A threaded opening 26 receives a threaded stud 28. The stud 28 is also received into a threaded bore 30 in the rearward end of the handle portion 12. The threaded stud 28 can also serve as one electrical connector, as will be described further below. The stud 28 extends into the battery compartment 20 and contacts the upper terminal base 38 of the battery 40. A spring 43 is mounted over the lower end 42 of the batteries 40 to provide a resilient force on the battery 40. An electrical communication system is provided to transmit electrical current from the batteries 40 to a light source 74. A first electrical conductor 48a and a second electrical conductor 48*b*, in electrical connection with the upper terminal base 38 and lower terminal base 42 of the batteries 40, respectively, penetrate the sidewall of the battery compartment 20 through a pair of conductor orifices 49, and are guided along the handle 12 by one of a pair of wires 50*a* or 50*b* (the pair best seen in cross-section in FIG. 7), and shown here as the first wire 50*a*. The arrangement of the second wire 50*b* is a mirror image of the first wire 50*a*. The first wire 50*a* and the second wire 50*b* are positioned along the outer surface of the handle 12, running parallel to one another. The first and second wires 50*a* and 50*b* are capacitive touch switches, wherein when a user's hand grasps the handle 12 so as to cover the two wires 50*a* and 50*b*, an electrical circuit is closed and electricity is allowed to flow. When the user releases the handle 12, the circuit is opened and electricity flow is stopped.

At the distal end of the handle 12 (FIG. 4), a tip receiving socket is formed in the handle 12 and forms a connection compartment having a threaded distal opening 52 for receiving one of the two tip portions 14. The first electrical conductor 48*a* passes through the first wire 50*a* and is in electrical communication with a conductive washer 54 that terminates the tip end of the handle 12, and functions as a first conductor attachment point as will be described below. The second electrical conductor 48*b* also passes through the first wire 50*a* and is in electrical connection with the conductive washer 54 and functions as a second conductor attachment point by penetrating the sidewall of the tip receiving compartment through a conductor orifices 56.

Figure 5:
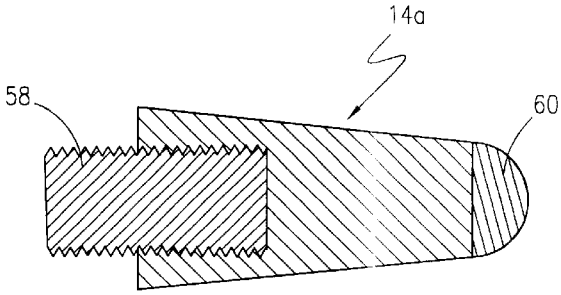
FIG. 5 is a view in section taken along line V—V of FIG. 1.

Referring now to FIG. 5, a breaking tip 14*a* is shown for removable, threaded attachment to the tip receiving socket such at to provide a rigid mechanical connection to the shaft handle 12. In this manner, the multi-compartment pool cue 10 can then be used as any otherwise conventional pool cue. It is anticipated that in this configuration, the pool cue 10 would be used during the initial "breaking" of the "racked" pool balls during a came of pocket billiards or the like. The threaded distal opening 52 receives a threaded tip stud 58. The tip stud 58 is also received into a threaded bore in the rearward end of the tip portion 14*a* formed as a tapered, solid body member having a cylindrical cross section which gently tapers from the handle toward a tip portion, and is terminated by a striking surface 60. Conventionally, the striking surface is formed of a leather disc coated on the exterior tip with chalk.

Figure 6:
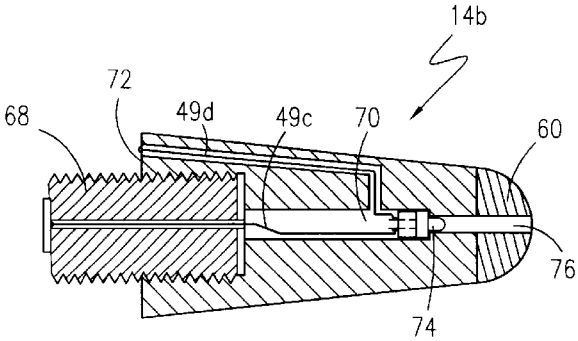
FIG. 6 is a view in section taken along line VI—VI of FIG. 1.
Figure 7:
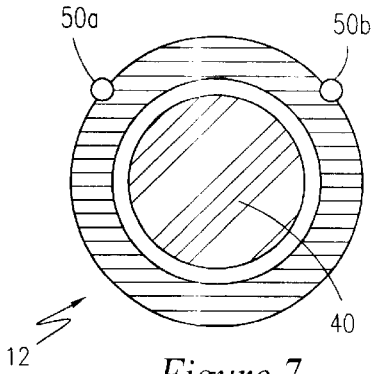
FIG. 7 is a cross-sectional view of the posterior end of the handle taken along the line VII—VII of FIG. 1.

Referring now to FIG. 6, an aiming tip 14*b* is shown for removable, threaded attachment to the tip receiving socket such at to provide a rigid mechanical connection to the shaft handle 12. The threaded distal opening 52 receives a threaded tip stud 68. The tip stud 68 is also received into a threaded bore in the rearward end of the tip portion 14*b* and provides access to a centrally bored chamber formed in the aiming tip 14*b* and forming an laser aiming compartment 70. The tip portion 14*b* is formed as a tapered member having a cylindrical cross section which gently tapers from the rear end to a front end, wherein the rear end is adjacent to and threadably attaches to the distal opening 52 of the handle 12. The tip 14*b* is terminated by a striking surface 60. The threaded tip stud 68 forms a central conduit through which a third electrical conductor 49*c* can pass, and a fourth electrical conductor 49*d* is further in contact with and communicates between the mating surface 72 of the base of the tip 14*b* that contacts the conductive washer 54 that terminates the tip end of the handle 12, and the laser aiming compartment 70. A collimated light source 74, such as a conventionally available laser pointer, is placed within the laser aiming compartment 70, and is in electrical communication with the conductors 49*c* and 49*d*, and thereby is powered by the batteries 40 in the handle when the tip 14*b* is secured to the handle 12. A light orifice 76 is formed at the tip, through the striking surface 60, to provide access to the laser aiming compartment 70 and allow beaming of the collimated light source 74 directly from the distal end of the aiming tip 14*b*, and the beam passes through a cylindrical opening in the resilient tip member as a highly collimated, narrow directional beam which is directed onto a spot on a cue ball or other billiard ball or pool ball.

Figure 8:
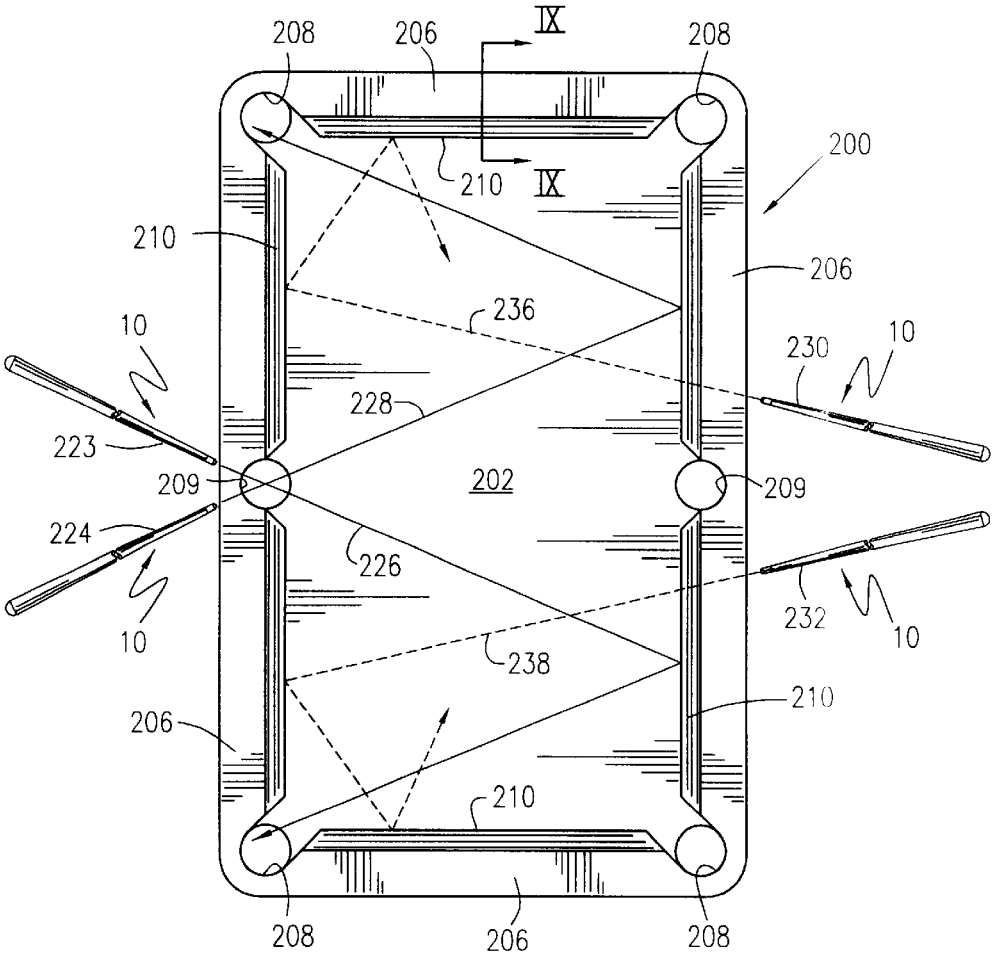
FIG. 8 is a top plan view of a pocket billiard table.
Figure 9:
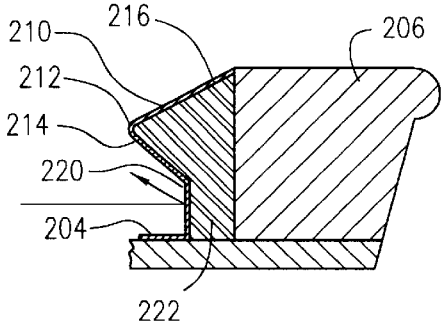
FIG. 9 is a view in section taken along the line IX—IX of FIG. 7 showing the aiming system of the present invention incorporated therein.

The pool cue 10 can also be utilized in conjunction with reflectorized bumpers as shown in FIGS. 8 and 9. A conventional pool table 200 includes a bed 202 of a hard but somewhat resilient material such as slate or marble in rectangular shape covered by a soft playing surface such as a layer 204 of felt. A raised perimeter is formed by a set of four rails 206. End pockets 208 are provided at the intersections of the side and end rails and side pockets 209 are provided at the midpoints of the side rails. The inner surface of the rails is provided with a set of bumpers 210 in the form of an inwardly facing triangle terminating in an apex 212 forming an overhang 214. The bumpers 210 may also be covered with a layer 216 of felt. A reflector system is formed in accordance with the invention by mounting a vertical reflector or mirror strip 220 within the overhang and beyond the point at which the apex 212 will be compressed during contact with the cue ball or other ball.

The strip 220 may be mounted on a triangular block 222 of resilient material which may be temporarily placed under each overhang 214. The strips may be secured by strips of interlocking fabric such as velcro. Six removable blocks 222 are required in order to form a complete reflectorized system for a pocket billiard table. Only four blocks 222 would be required for a regular billiard table.

Referring now to FIG. 8, the pool cue 10 is placed on the rail 206. When the cue is in position 223 or 224, it will project a bank shot 226 or 228 into corner pockets 203. However, when the cue is in position 230 or 232, aiming patterns 236 and 238 will be projected showing that the cue ball will not enter any pocket.

Figure 10:
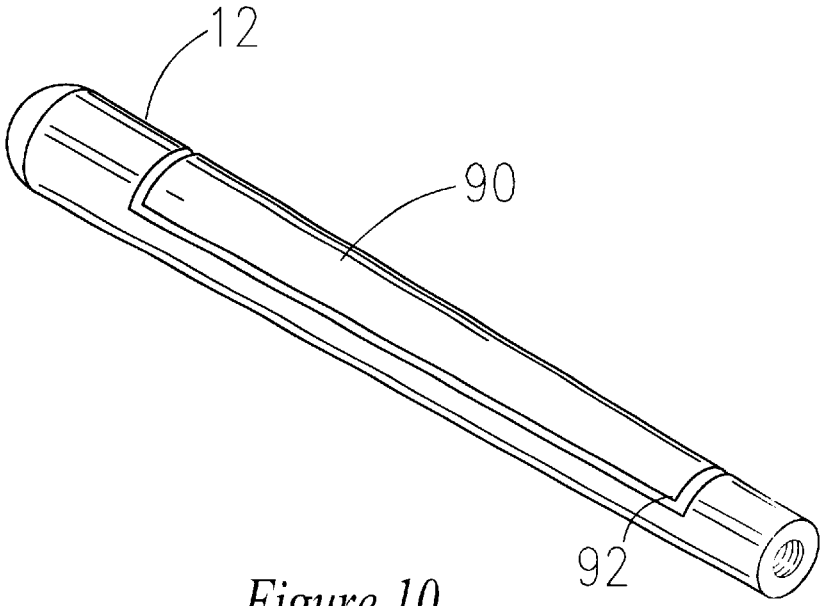
FIG. 10 is an alternative embodiment of the pressure sensitive handle, in which the handle is a hinged lever which contacts a wire to complete an electrical circuit and allow the flow of electricity.

Referring now to FIG. 10, an alternative embodiment of the present invention is shown, wherein the handle 12 includes a lever 90. The lever 90 is a curvilinearly elongated, semi-arcuate member affixed at one end to the handle 12 by a hinge 92. When the lever 90 is squeezed downwardly toward the handle 12, the electrical circuit is closed, thereby allowing electrical current to flow and generate a laser. When the lever 90 is in a resting position, the electrical circuit is open, thus electrical current flow is blocked and no laser is generated. The electrical circuitry may comprise the two wire system describe above (the first wire 50*a* and the second wire 50*b*), or a one wire system (either the first or second wire 50*a* or 50*b*).

2. Operation of the Preferred Embodiment

In operation, the present invention is can be used in many ways. Primarily, by attaching the breaking tip 14*a* to the base handle portion 12, the pool cue 10 can be used for the initial "break" portion of conventional pocket billiards. Thereafter, the breaking tip 14*a* can be unthreaded, and replaced by the aiming tip 14*b*. Upon subsequent strikes at the cue ball, an aiming light can thereafter be generated from the distal end of the pool stick 10 as described above.

Further, the present invention can be used as a training an practice item. With the aiming tip 14*b* in place upon the handle 12, the cue stick can then be aligned behind a cue ball with the collimated light source shining onto the surface of the ball. As the user moves the cue stick back and forth, the dot of light on the ball should remain neat the same spot at all times, with only slight up and down motion. However, if the dot of light moves excessively, or in random directions, then the user can practice the proper drawing of the stroke, keeping a smooth pendulum action as a result of this visual feedback.

Alternately, availability and use of the present invention can allow for unconventional play with pocket billiards as well. For example, use of flourescent colored balls, and in combination with black lighting can allow for playing variations of pocket billiards in the dark while still allowing the user to utilize his or her aiming skills. And, in combination with a table having reflectorized bumpers as described above, and in further combination with the use of a fog generating means, various visual reflective effects can be generated.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A multi-component pool cue alignment apparatus comprising:

a pressure sensitive handle, said handle tapering from a proximal end to an opposing distal end, wherein said handle comprises a pair of capacitive touch switch wires, wherein said pair of wires comprise a first wire and a second wire, said first wire and said second wire positioned along an outer surface of said handle, said first wire and said second wire running parallel to one another from said proximal end to said distal end;

a bumper, said bumper comprising a threaded bore for housing a threaded bumper stud;

a threaded proximal opening, said proximal opening formed in said proximal end, said proximal opening threadably receiving said bumper stud;

a battery compartment, said battery compartment formed distally adjacent to said proximal opening, said battery compartment housing batteries;

a threaded distal opening, said distal opening formed in said distal end, said distal opening receiving a tip stud;

a removable tip, said tip tapering from a rear end to an opposing front end, said opposing front end including a striking surface, said rear end including a tip stud; and an electrical communication system, said system electrically coupled to said battery compartment and channeling through said handle so as to provide transmission of electrical current from said handle to said tip when said handle is depressed.

2. The pool cue alignment apparatus of claim 1, wherein said first wire and said second wire each comprise:

a first electrical conductor, said first electrical conductor electrically coupled with an upper terminal base of said battery compartment; and a second electrical conductor, said second electrical conductor electrically coupled with a lower terminal base of said battery compartment.

3. The pool cue alignment apparatus of claim 2, wherein said first electrical conductor is electrically coupled with a conductive washer terminating at said distal end of said handle, thereby providing a first conductor attachment point.

4. The pool cue alignment apparatus of claim 3, wherein said second electrical conductor is electrically coupled with said conductive washer, thereby providing a second conductor attachment point.

5. The pool cue alignment apparatus of claim 4, wherein said removable tip is threadably coupled to said distal end by way of said tip stud.

6. The pool cue alignment apparatus of claim 5, wherein said tip comprises a solid body terminating at said front end as a striking surface, said solid body adapted for breaking a rack of pool balls.

7. The pool cue alignment apparatus of claim 5, wherein said tip comprises a light orifice penetrating said striking surface, said light orifice coupled to a light source.

8. The pool cue alignment apparatus of claim 7, wherein said tip further comprises:

a third electrical conductor, said third electrical conductor transversing said tip stud and electrically coupling to said light source;

a fourth electrical conductor, said fourth electrical conductor coupling to a mating surface of said tip at one end and coupling to said light source at an opposing end;

said third electrical conductor and said fourth electrical conductor transmitting electricity generated by said batteries to said light source.

9. The pool cue alignment apparatus of claim 8, wherein said light source transmits light through a collimated chamber and said light orifice, said light projecting onto an object in alignment with said striking surface and said apparatus.

10. A multi-component pool cue alignment apparatus comprising:

a pressure sensitive handle, said handle tapering from a proximal end to an opposing distal end, wherein said handle comprises a curvilinearly elongated, semi-arcuate lever;

a bumper, said bumper comprising a threaded bore for housing a threaded bumper stud;

a threaded proximal opening, said proximal opening formed in said proximal end, said proximal opening threadably receiving said bumper stud;

a battery compartment, said battery compartment formed distally adjacent to said proximal opening, said battery compartment housing batteries;

a threaded distal opening, said distal opening formed in said distal end, said distal opening receiving a tip stud;

a removable tip, said tip tapering from a rear end to an opposing front end, said opposing front end including a striking surface, said rear end including a tip stud; and an electrical communication system, said system electrically coupled to said battery compartment and channeling through said handle so as to provide transmission of electrical current from said handle to said tip when said handle is depressed.

11. The pool cue alignment apparatus of claim 10, wherein said lever is affixed to said handle by a hinge.

12. The pool cue alignment apparatus of claim 11, wherein said lever contacts said electrical communication system, thereby completing a circuit for providing electrical current.

13. The pool cue alignment apparatus of claim 12, wherein said electrical communication system is a first wire contained within said handle, said first wire comprising a first electrical conductor electrically coupled with an upper terminal base of said battery compartment and a second electrical conductor electrically coupled with a lower terminal base of said battery compartment.

14. The pool cue alignment apparatus of claim 13, wherein said first electrical conductor is electrically coupled with a conductive washer terminating at said distal end of said handle, thereby providing a first conductor attachment point.

15. The pool cue alignment apparatus of claim 14, wherein said second electrical conductor is electrically coupled with said conductive washer terminating at said distal end of said handle, thereby providing a second conductor attachment point.

16. The pool cue alignment apparatus of claim 15, wherein said removable tip is threadably coupled to said distal end by way of said tip stud.

17. The pool cue alignment apparatus of claim 16, wherein said tip comprises a solid body terminating at said front end as a striking surface, said solid body adapted for breaking a rack of pool balls.

18. The pool cue alignment apparatus of claim 17, wherein said tip comprises a light orifice penetrating said striking surface, said light orifice coupled to a light source.

19. The pool cue alignment apparatus of claim 18, wherein said tip further comprises:

a third electrical conductor, said third electrical conductor transversing said tip stud and electrically coupling to said light source;

a fourth electrical conductor, said fourth electrical conductor coupling to a mating surface of said tip at one end and coupling to said light source at an opposing end;

said third electrical conductor and said fourth electrical conductor transmitting electricity generated by said batteries to said light source, said light source transmitting light through a collimated chamber and said light orifice.

* * * * *